US006986487B2

(12) United States Patent
Rich

(10) Patent No.: US 6,986,487 B2
(45) Date of Patent: Jan. 17, 2006

(54) BABY BOTTLE HOLDER

(76) Inventor: Jeffrey S. Rich, 444 E. 82nd St., New York, NY (US) 10021

( * ) Notice: Subject to any disclaimer, the term of this patent is extended or adjusted under 35 U.S.C. 154(b) by 0 days.

(21) Appl. No.: 10/431,319

(22) Filed: May 7, 2003

(65) Prior Publication Data

US 2004/0222334 A1 Nov. 11, 2004

(51) Int. Cl.
*A47D 15/00* (2006.01)

(52) U.S. Cl. ..... 248/104

(58) Field of Classification Search ..... 248/102, 248/103, 104, 105, 106; D24/199
See application file for complete search history.

(56) References Cited

U.S. PATENT DOCUMENTS

| | | | | | |
|---|---|---|---|---|---|
| 1,729,531 | A | * | 9/1929 | Wolever | 248/105 |
| 2,717,753 | A | * | 9/1955 | Schweikert | 248/106 |
| 3,635,431 | A | * | 1/1972 | Mariner | 248/104 |
| 4,014,505 | A | * | 3/1977 | Dowd | 248/105 |
| 4,220,302 | A | * | 9/1980 | Hampton et al. | 248/102 |
| 4,309,008 | A | * | 1/1982 | Sirks | 248/105 |
| 4,750,696 | A | | 6/1988 | Shan-Liang | 248/102 |
| 4,809,938 | A | | 3/1989 | Skinner et al. | 248/102 |
| 4,953,816 | A | * | 9/1990 | Wilkinson | 248/102 |
| 4,961,555 | A | * | 10/1990 | Egan, Jr. | 248/231.81 |
| 4,965,888 | A | * | 10/1990 | Jones | 2/104 |
| D313,472 | S | | 1/1991 | Pierce | D24/48 |
| D321,938 | S | | 11/1991 | Burt | D28/199 |
| 5,083,732 | A | | 1/1992 | Akamine | 248/104 |
| D325,636 | S | * | 4/1992 | Putnam | D24/199 |
| D331,112 | S | | 11/1992 | Bachelor | D24/199 |
| 5,184,796 | A | | 2/1993 | Maher | 248/104 |
| D334,983 | S | | 4/1993 | Nicholls | D24/198 |
| D338,069 | S | | 8/1993 | McCormick | D24/199 |
| D358,892 | S | | 5/1995 | Kahn | D24/199 |
| D364,228 | S | | 11/1995 | Goler | D24/199 |
| 5,489,075 | A | | 2/1996 | Ible | 248/104 |
| D369,413 | S | | 4/1996 | Lodewyck, Jr. et al. | D24/199 |
| 5,613,657 | A | | 3/1997 | Olaiz | 248/102 |
| 5,711,500 | A | | 1/1998 | De Los Santos | 248/102 |
| 5,765,225 | A | | 6/1998 | Goeckeritz et al. | 2/49.1 |
| 5,765,704 | A | | 6/1998 | Cameron | 215/11.6 |
| 5,769,367 | A | | 6/1998 | Bradley et al. | 248/102 |
| 5,794,898 | A | | 8/1998 | Bradley et al. | 248/102 |
| 5,823,486 | A | * | 10/1998 | Smith et al. | 248/104 |
| D403,073 | S | | 12/1998 | Hrdlicka | D24/199 |
| 5,901,468 | A | * | 5/1999 | Whyte | 36/71 |
| 5,918,838 | A | | 7/1999 | Strandberg | 248/106 |
| 6,056,246 | A | | 5/2000 | Argy, II | 248/103 |

(Continued)

FOREIGN PATENT DOCUMENTS

AU 140990 B1 * 12/1948

*Primary Examiner*—Jonathon Szumny
(74) *Attorney, Agent, or Firm*—Mayer, Brown, Rowe & Maw, LLP

(57) ABSTRACT

A baby bottle holder with a wide base for stability with a concaved based portion for resting upon an infant is disclosed. The bottle holder has two self adjusting arms that grip the infant for hands free feeding leaving the care giver free to perform other tasks. Cylindrical like walls grip the bottle firmly and thereby allowing for easily insertion or removal of the baby bottle. The baby bottle holder retains the bottle at an angle that allowing the flow of liquids for comfortable feeding. The baby bottle holder also is shaped to act as a handle allowing the infant child to easily grip the bottle; and can be used as a teething toy.

8 Claims, 3 Drawing Sheets

U.S. PATENT DOCUMENTS 6,082,681 A 7/2000 Rand ..... 248/102
6,098,934 A 8/2000 Skelton ..... 248/102
D439,671 S 3/2001 Casillo et al. ..... D28/199
D462,775 S 9/2002 Minor ..... D24/199

* cited by examiner

BABY BOTTLE HOLDER

FIELD OF INVENTION

This invention relates to a baby bottle holder which permits a feeder free use of their arms.

BACKGROUND OF INVENTION

There are many baby bottle holders. Most of them are over engineered and contain metal or fabric and thus pose hazards for their intended purpose. For example, metal devices are bad for growing teeth as babies love to bite anything within their reach. Moreover, fabric covered bottle holders present a cleaning problem and trap bacteria and mold.

A variety of designs have been proposed for bottle holders. Some of the designs rest on the baby's chest with straps to secure the bottle holder around the baby, while other designs use a clamp to secure the bottle holder. Other designs have to fix a supporting clamp and an adjustable arm which extends holding the bottle into place with a second clamp holds the baby bottle. Still other designs use a foam wedge and strap to secure the baby bottle. Yet other designs are weighted to rest and wrap around a baby's torso while others are disguised as animals.

While all of the aforementioned prior designs are adequate for the basic purpose and function of holding a baby bottle none of them are truly hands free and do not move with the infant. Many of the present designs will not release from the infant's mouth when feeding is completed resulting in liquid spills and tooth decay as liquid pools around an infant's teeth.

Thus there is a need for a bottle holder that allows for self-adjusting arms that move with the baby while providing gentle compressive forces holding the baby bottle around the infant child. There is a further need for a baby bottle holder designed using a one piece construction. There is also a need for a multifunctional device which can be used as a teething toy, can acts as a bottle handle, a bottle holder and wraps around the infant child without straps.

There is a further need for a baby bottle holder having a bottom portion that is concaved so that baby bottle holder can rest comfortable upon a baby's chest. There is also a need for a hands free baby bottle holder that may be used in a car seat, carriage or resting in a caregiver's arms. Another need is for a baby bottle holder that can be held in a vertical position to allow quick and easy removal of the bottle and which firmly grips the bottle yet allows easy removal. Yet another need is for a baby bottle holder that is self-locking to grip a variety of bottle shapes and widths and provides a wide base for stability. Still another need is for a baby bottle holder that tilts away from a baby's mouth when not in use preventing liquid from pooling near the mouth.

SUMMARY OF THE INVENTION

These needs and others may be met by the present invention which is may be embodied in a baby bottle holder having a base member. The holder also has an upper portion having an aperture and a lower portion having two arms. The base member is flexible and allows the retention of a concave shape. The two arms may be swiveled away from the base member.

A second example of the present invention is a baby bottle holder that allows for a person feeding an infant to have their hands free. The bottle holder has a base having an upper portion and a lower portion with a surface which may be deformed in a concave shape for resting upon the infant's chest. Two arms are provided which are bendable horizontally outward from the base to provide compressive forces against the sides of the infant to prevent the bottle holder from moving. An ornamental shaped body portion is provided. A top portion of the bottle holder includes an aperture to provide frictional retaining of a baby bottle.

It is to be understood that both the foregoing general description and the following detailed description are not limiting but are intended to provide further explanation of the invention claimed. The accompanying drawings, which are incorporated in and constitute part of this specification, are included to illustrate and provide a further understanding of the method and system of the invention. Together with the description, the drawings serve to explain the principles of the invention.

DESCRIPTION OF THE PREFERRED EMBODIMENT

Figure 1:
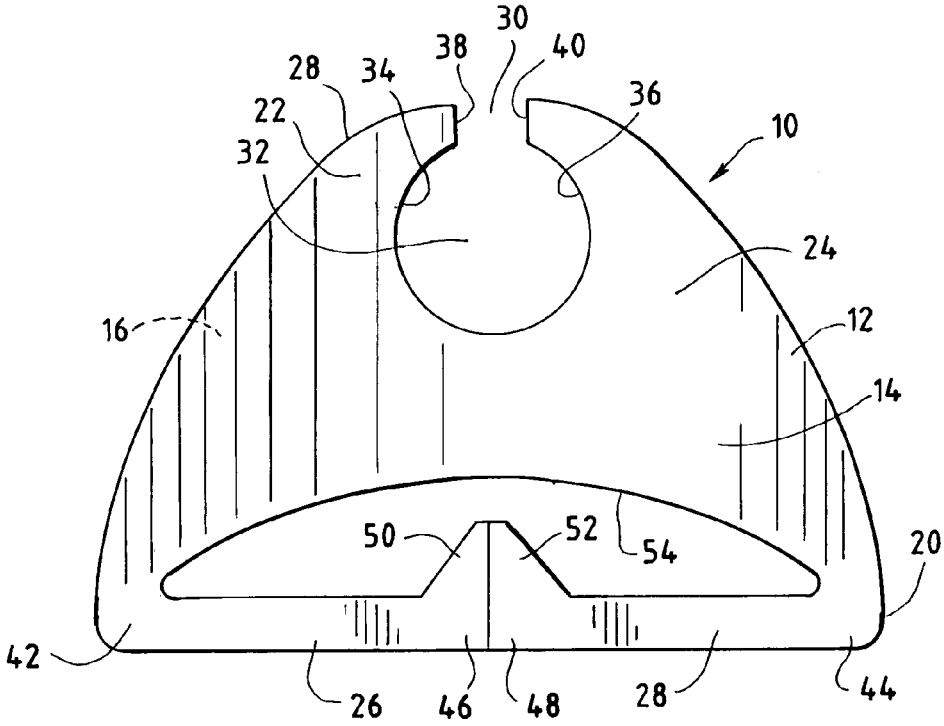
FIG. 1 is a front view of a bottle holder which is an example of the present invention with the arms in a retracted position.

While the present invention is capable of embodiment in various forms, there is shown in the drawings and will hereinafter be described a presently preferred embodiment with the understanding that the present disclosure is to be considered as an exemplification of the invention, and is not intended to limit the invention to the specific embodiment illustrated.

Referring to FIGS. 1–5, a baby bottle holder 10 is shown. The baby bottle holder 10 has a wide base 12 with a concave top surface 14 and an opposite convex surface 16. The base 12 further has an upper portion 18 and a lower portion 20. The upper portion 18 is split into two halves 22 and 24 respectively. The lower portion 20 has two arms 26 and 28. A keyhole cutout 30 is located between the two halves 22 and 24 of the upper portion 18. The keyhole cut out 30 has a circular center 32 defined by two opposite cylindrical walls 34 and 36 respectively. The keyhole cut out 30 is further defined by two opposite vertical walls 38 and 40. The cylindrical walls 34 and 36 are flexible and resilient. The two vertical walls 38 and 40 allow the cylindrical walls 34 and 36 to open and closed by virtue of the inherent resilience of the cut out 30, to grip or release a baby bottle. It is to be understood that the upper portion 18 is not limited to the keyhole cut out shape 30 as an hourglass shape, a U channel, circles, square or hex and the like shapes with or without a cut out which may provide a frictional retention of a bottle may be used.

Figure 2:
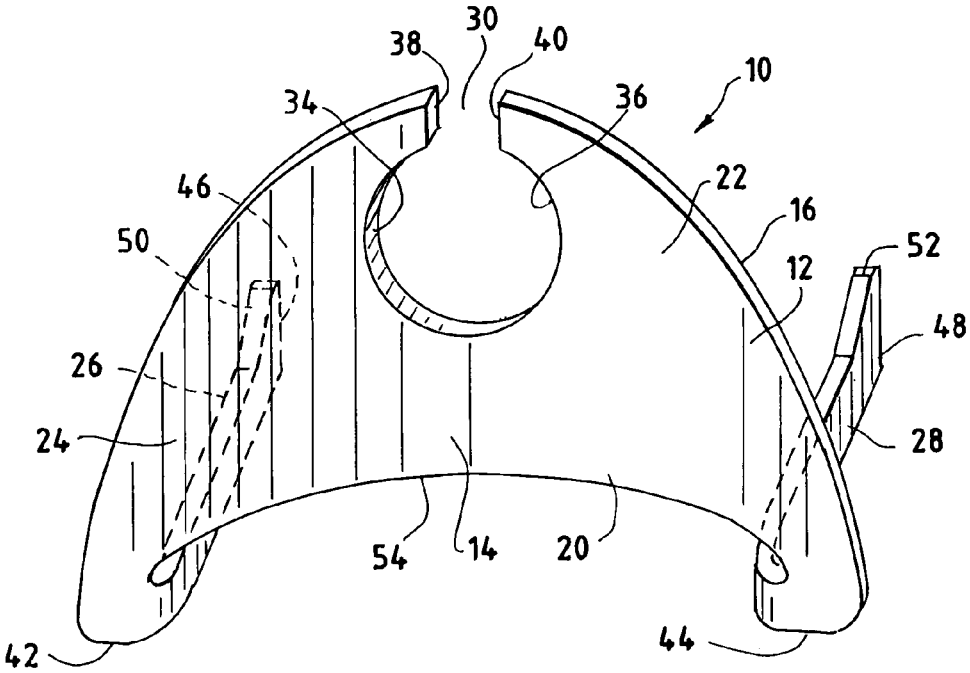
FIG. 2 is a perspective view of the bottle holder in FIG. 1 with the arms extended horizontally.
Figure 3:
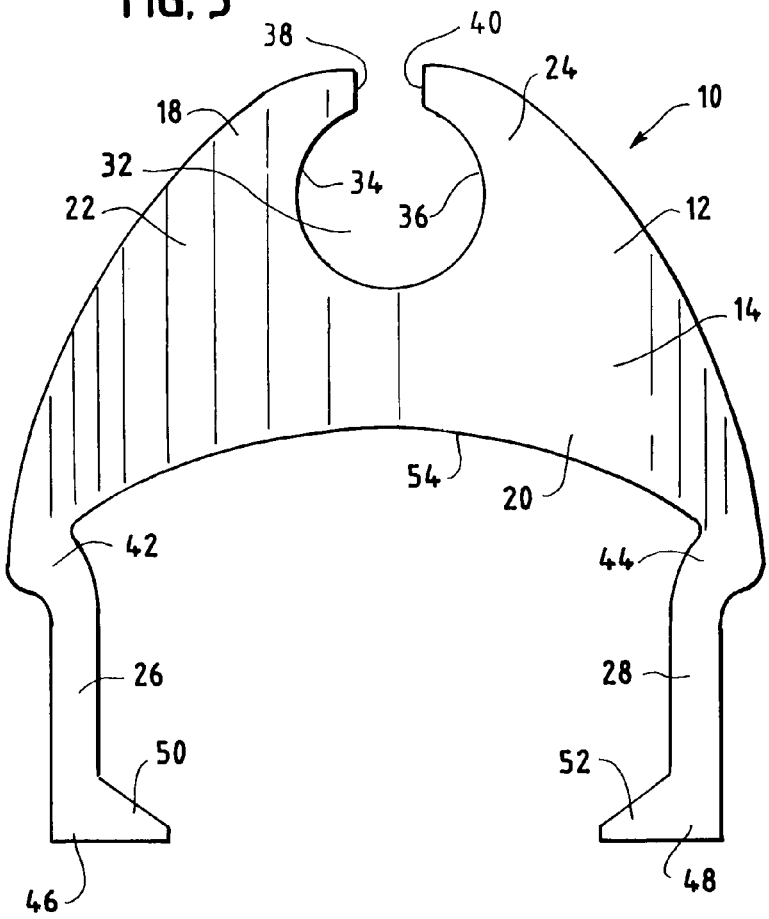
FIG. 3 is a front view of the bottle holder in FIG. 1 with the arms extended vertically.
Figure 4:
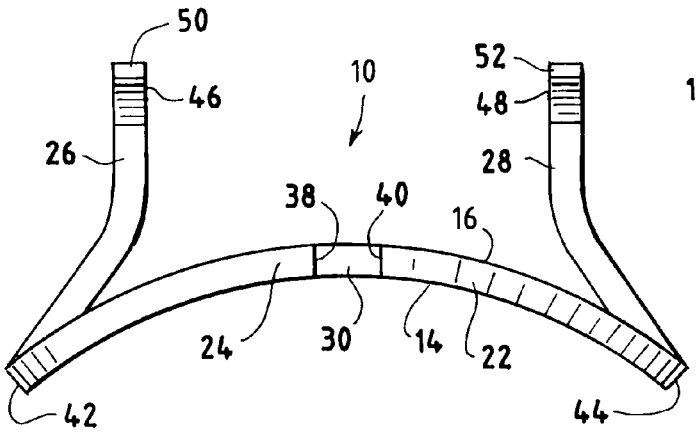
FIG. 4 is a top view of the bottle holder in FIG. 1 with the arms extended horizontally.
Figure 5:
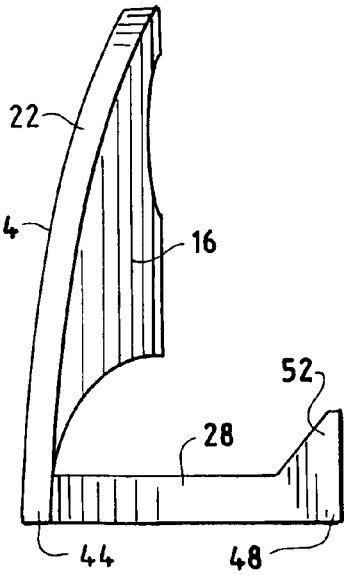
FIG. 5 is a side view of the bottle holder in FIG. 1 with the arms extended horizontally.

The two arms 26 and 28 of the lower portion 20 may be swiveled around pivot points 42 and 44 respectively. The arms 26 and 28 have ends 46 and 48 respectively which are located opposite from the points 42 and 44. The ends 46 and 48 are wedge shaped having hook members 50 and 52 respectively. Of course other shapes such as a square or rounded shape may be used as well. The arms 26 and 28 may be stored in a retracted position as shown in FIG. 1 with the ends 46 and 48 brought together. The arms 26 and 28 may also be swiveled out from the pivot points 42 and 44 at a parallel plane to the base 12 as shown in FIG. 3. Alternatively, the arms 26 and 28 may be swiveled in a perpendicular plane to the base 12 as shown in FIG. 2. The lower portion 20 has an arced bottom wall 54 which forms a resting surface to contact the infant as will be described below.

The bottle holder 10 is preferably fabricated from a resilient flexible material including open or closed foam, ethyl vinyl acetate (EVA), rubber such as sub butadiene rubber (SBR) or plastic. The example is fabricated from 12 Iron, (½"), 55–60 durometer EVA which allows flexibility in the base 12 and the arms 26 and 28 but retains the various parts in the positions manipulated by the user and cannot be torn. This material is also firm, yet resilient rubber which infants can teeth on without damaging teeth. In addition such material allows a one-piece construction which is lightweight and inexpensive and can be easily manufactured in large numbers.

Figure 6:
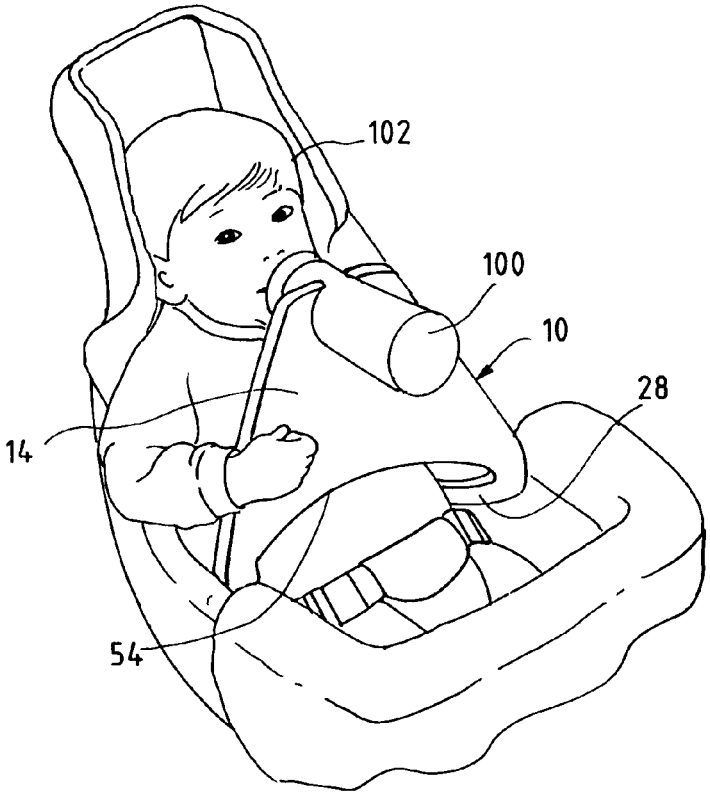
FIG. 6 is a perspective view of the bottle holder in FIG. 1 holding a bottle and placed on a baby in a horizontal position.

Those of skill in the art will recognize that the design allows the adjustable arms 26 and 28 that apply gently compressive forces to the sides of the torso of an infant 102, holding a bottle 100 in place as shown in FIG. 6. The lower portion 20 is concaved so that baby bottle holder 10 can rest comfortable upon the infant's chest. The bottle 100 is placed within the key hole cutout 30. The two opposite vertical walls 38 and 40 are then pushed together to retain the bottle 100 between the cylindrical walls 34 and 36. The baby bottle holder 10 retains the bottle 100 at an angle that allowing the flow of liquids for comfortable feeding to the infant 102.

The bottle holder 10 is shown in FIG. 6 placed on an infant 102 which is in a horizontal position. The bottom surface 16 rests on top of waist of the infant 102. The two arms 26 and 28 can be extended as shown in FIG. 2 and then be turned inward, gripping the torso of the infant 102 as pivoted in a slightly perpendicular plane to the base 12 as in FIG. 6. Since the bottle holder 10 is secured to the infant 102, the baby bottle holder 10 moves with the infant 102 when sitting or laying on its side offering, totally hands free feeding so a care giver is free to perform other tasks.

Figure 7:
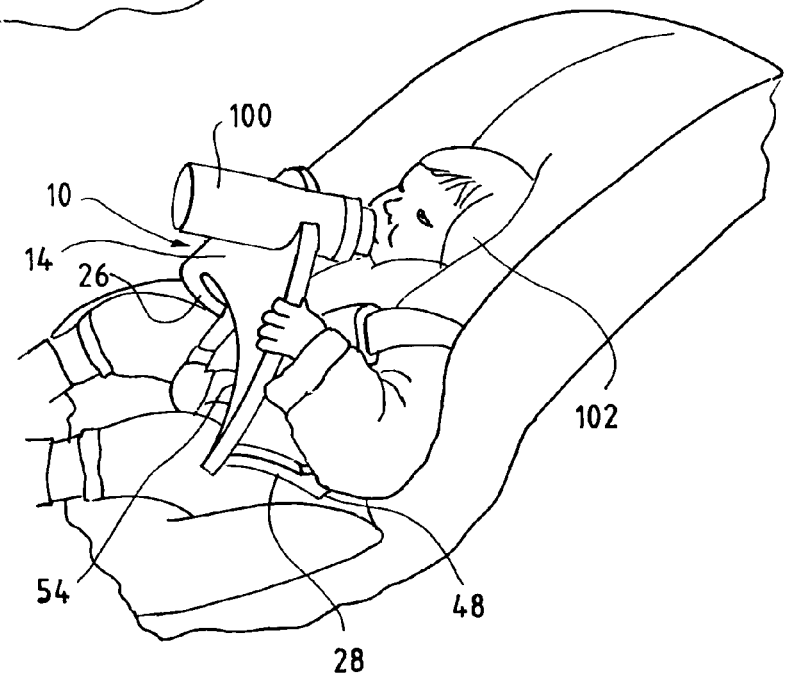
FIG. 7 is a perspective view of the bottle holder of FIG. 1 holding a bottle and placed on a baby in an upright position.

Alternatively, the arms 26 and 28 may be extended vertically with the ends of the arms 46 and 48 keeping the bottle holder 10 from moving up as shown in FIG. 2. With arms 26 and 28 extended as in FIG. 2, the base 12 arches slightly as shown in FIG. 7 adding compression forces to the cylindrical walls 34 and 36 to grip the bottle 100. The arms 26 and 28 are then bent inward around the torso of the baby 102. The bottle holder 10 thus acts as a fulcrum when the bottle 100 is inserted in the hole 30. The majority of the length of the bottle 100 does not protrude through the hole 30 to the baby 102 which allows the bottle 100 to tilt back when the baby opens his or her mouth.

The configuration shown in FIG. 7 allows the baby bottle holder 10 to be used in a car seat, carriage or resting in caregivers arms. The baby bottle holder 10 can be held in a vertical position to allow quick and easy removal of the bottle 100. The baby bottle holder 10 retains the bottle 100 at an angle that allowing the flow of liquids for comfortable feeding of the infant 102.

Since the arms 26 and 28 are adjustable, the baby bottle holder 10 can grip a variety of bottle shapes and widths that is self-locking. The ends 46 and 48 may act as handles for a user to carry the bottle 100 gripped in the bottle holder 10. The baby bottle holder 10 is thin enough so it can be gripped easily by the baby to encourage and enhance eye and hand coordination. The size of the baby bottle holder 10 is such that it is portable and can be laid flat taking minimal amount of space. The baby bottle holder 10 can be easily cleaned and dried to prevent infection to the baby.

It will be apparent to those skilled in the art that various modifications and variations can be made in the method and system of the present invention without departing from the spirit or scope of the invention. Thus, the present invention is not limited by the foregoing descriptions but is intended to cover all modifications and variations that come within the scope of the spirit of the invention and the claims that follow.

What is claimed is:

1. A baby bottle holder comprising:

a triangularly shaped base member having a planar surface area;

an upper portion of the planar surface area having an aperture, sized to provide frictional holding of a baby bottle, the aperture being a round cut out and having a notch cut from the upper portion to the round cutout;

a lower portion of the planar surface area having a greater width than the upper portion, the lower portion having a bottom side with two opposite ends, having two arms attached to the opposite ends;

wherein the base member is flexible and allows the retention of a concave shape; and wherein the two arms may be swiveled and fixed in place from a position planar to the planar surface area away from the base member to a position roughly perpendicular with the planar surface area.

2. The baby bottle holder of claim 1 wherein the arms may be extended vertically downward from the base to providing compressive forces against the torso of an infant preventing the bottle holder from moving.

3. The bottle holder of claim 1 wherein the upper and lower portions and arms are fabricated from plastic.

4. The bottle holder of claim 1 wherein the lower portion has a curved edge which may be conformed to the torso of an infant.

5. The bottle holder of claim 1 wherein the arms have ends which are wedge shaped.

6. The bottle holder of claim 1 wherein the upper and lower portions and arms are fabricated from ethyl vinyl acetate (EVA).

7. The bottle holder of claim 1 wherein the upper and lower portions and arms are fabricated from foam.

8. The bottle holder of claim 1 wherein the upper and lower portions and arms are fabricated from rubber.

* * * * *